US006146435A

United States Patent [19]

Stork

[11] Patent Number: 6,146,435

[45] Date of Patent: Nov. 14, 2000

[54] BIOFILTER

[76] Inventor: Hans Stork, Lindenstrasse 21, D-78576 Emmingen-Liptingen, Germany

[21] Appl. No.: 09/247,218

[22] Filed: Feb. 10, 1999

[30] Foreign Application Priority Data

Feb. 12, 1998 [DE] Germany ..... 198 05 604

[51] Int. Cl.[7] ..... B01D 53/04

[52] U.S. Cl. ..... 55/385.1; 55/421; 55/502; 55/518; 96/131; 96/147; 96/151

[58] Field of Search ..... 210/163, 164, 210/188, 299, 450, 451, 463, 472, 474, 475, 476, 482; 96/121, 131, 133, 137, 139, 147, 151, 222; 55/385.4, 421, 502, 518, 385.1; 404/25; 277/605, 626, 645, 646

[56] References Cited

U.S. PATENT DOCUMENTS

| | | | |
|---|---|---|---|
| 2,910,209 | 10/1959 | Nelson | 277/645 |
| 3,891,224 | 6/1975 | Ditcher | 277/605 |
| 4,586,941 | 5/1986 | Cooley | 96/147 |
| 5,284,580 | 2/1994 | Shyh | 210/163 |

FOREIGN PATENT DOCUMENTS

| | | |
|---|---|---|
| 626189 | 11/1994 | European Pat. Off. . |
| 745731 | 12/1996 | European Pat. Off. . |
| 652125 | 10/1937 | Germany . |

*Primary Examiner*—Matthew O. Savage
*Attorney, Agent, or Firm*—Bachman & LaPointe, P.C.

[57] ABSTRACT

In a biofilter, in particular for installation in discharge systems, with a collecting funnel and with an adjoining filter housing (13), the collecting funnel is to have a mounting ring (1), into which the filter housing (13) is inserted removably.

12 Claims, 2 Drawing Sheets

BIOFILTER

BACKGROUND OF THE INVENTION

The invention relates to a biofilter, in particular for installation in discharge systems, with a collecting funnel and with an adjoining filter housing.

A filter of this type is known, for example, from EP 0 745 731 A1. A disadvantage of this filter is that it is produced, as a whole, as a unit which is inserted into a manhole. Insofar as the manholes have different diameters or designs, at least the insert part of this filter must be adapted to the manhole.

Furthermore, in order to exchange the filter material or to clean the filter, it is necessary to take the entire filter out of the manhole. It is difficult and heavy to handle. Moreover, the necessary seals are often damaged.

Present invention to develop a biofilter as mentioned above fits into widely differing manholes and is easy to handle.

In order to achieve the foregoing object, the collecting funnel has a mounting ring, into which the filter housing is inserted removably.

SUMMARY OF THE INVENTION

The essence of the present invention is that the mounting ring always remains in the manhole, while only the filter housing is taken out and exchanged or cleaned. As is already known, in a normal manhole the mounting ring is supported against the manhole wall via a circular rubber cord. Since the mounting ring is not taken out of the manhole when the filter cartridge is exchanged or the insert cleaned, the circular rubber cord is also not exposed to any wear. If the manhole has a different dimension, it is possible for the mounting ring to be foam-fitted into the manhole, so that very good sealing and also retention of the mounting ring take place. A mounting ring of this type, and, with it, also the biofilter according to the invention, can consequently be used for all existing manholes.

Should the manholes have a different diameter or a different cross section, it is necessary merely for the mounting ring to be adapted to this difference or else for the mounting ring then to be fitted into an adaptor which is adapted to the respective manhole. It is thereby also possible, for example, to arrange a plurality of biofilters next to one another in a large manhole, said biofilters being drawn out of the adaptor or the correspondingly adapted mounting ring in order to be exchanged or cleaned.

By virtue of this design, the sand trap is also no longer a holder for the entire filter, so that it, too, can be produced from plastic. It consequently becomes substantially lighter and can be removed separately.

Preferably, the filter housing is connected to a filter upper part which rests on an inner seal, the latter, in turn, resting on an inner flange on the mounting ring. The filter upper part and filter housing, if appropriate together with a cover yet to be mentioned, are therefore connected to form an insert which can be drawn as a whole out of the mounting ring in order to exchange the filter material or for cleaning purposes. This insert is substantially lighter, since it as a whole or its individual parts can be produced from plastic.

When the insert is being taken out, the inner seal, which is preferably designed to adhere on one side to the inner flange, remains on the latter and is not damaged, so that its function is not impaired.

Preferably, the mounting ring is to be supported against a manhole wall via a sealing ring. This sealing ring is designed with a D-shaped cross section and, in this case, possesses an approximately straight back and a curved part. The straight back is to be designed to be more rigid than the curved part. The advantage of this is that it becomes substantially easier for the mounting ring to be taken out of and inserted into the manhole, since the sealing ring does not roll away, but remains bearing with the straight back on the mounting ring.

In order to make it even easier to take out and insert the mounting ring, perforations, from which air can escape out of an inner space, are to be integrally formed in the sealing ring. The diameter of the sealing ring can thereby be reduced, without said sealing ring being displaced out of its position round the mounting ring.

The entire biofilter is to be formed from plastic in a substantially simpler production method. In this case, according to the invention, only two molds are necessary, one mold being intended for the filter housing and at least one intermediate plate, while the mounting ring, the cover and the filter upper part are formed in the other mold. The individual parts are then separated from one another by means of appropriate cutting lines. An intermediate plate provided with slots is cut out from the bottom of the filter housing by means of at least one cutting line. If the bottom is designed with correspondingly longer corrugations, even two intermediate plates can be cut out.

The cover and the filter upper part are in each case cut off from one side of the mounting ring.

During assembly, the cover is inserted into the filter upper part and is welded there. The cover serves essentially for supporting the sand trap. It also forms, however, an outlet orifice, through which water can fall into an outlet in the filter upper part. This outlet in the filter upper part is preferably closed by means of a selfclosing flap, this flap or the corresponding flap mechanism likewise being welded to the filter upper part.

BRIEF DESCRIPTION OF THE DRAWING

Further advantages, features and details of the invention may be gathered from the following description of preferred exemplary embodiments and with reference to the drawing in which.

DESCRIPTION OF PREFERRED EMBODIMENT

Figure 1:
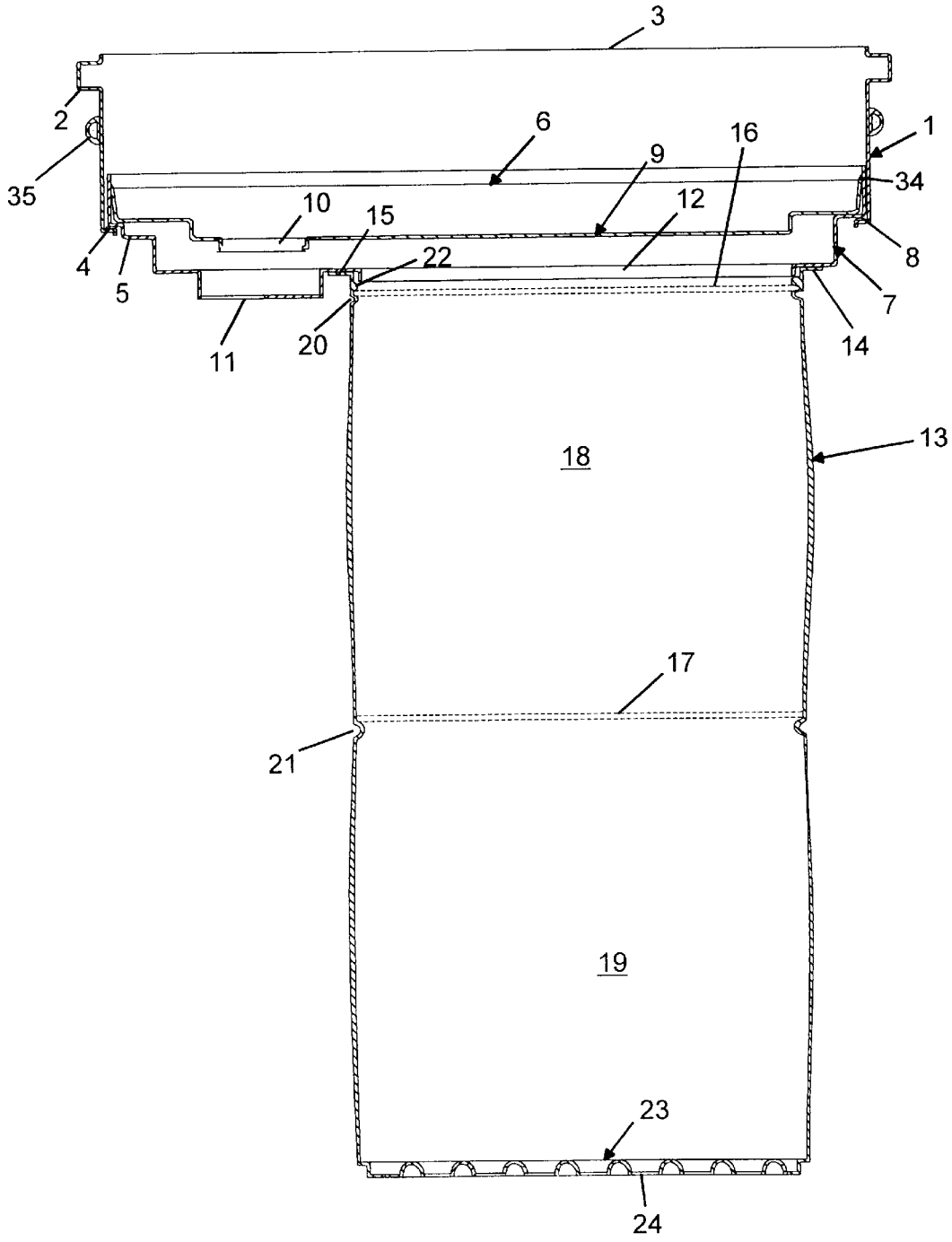
FIG. 1 shows a cross section through a biofilter according to the invention.

A biofilter according to FIG. 1 has a mounting ring 1 which is inserted, for example, into a manhole of a discharge system. For this purpose, the mounting ring 1 possesses supporting bosses 2, four supporting bosses preferably being provided opposite one another on the mounting ring for resting the biofilter on a shoulder of the manhole.

The mounting ring 1 forms upwardly an orifice 3, through which water to be discharged can enter. An inner flange 4 delimits downwardly a further orifice 5, into which an insert 6 is inserted removably. For this purpose, a filter upper part 7 is supported on an inner seal 8 which rests on the inner flange 4. This inner seal 8 is preferably designed to be adhesive on one side, so that it adheres to the inner flange 4.

Inserted into the filter upper part 7 is a cover 9, on which, for example, a sand trap may be seated. Integrally formed in the cover 9 is an outlet orifice 10 arranged above an outlet 11 which, in turn, is formed by the filter upper part 7. This outlet 11 is preferably assigned a closing flap not shown in any more detail. A closing flap of this type can be seen, for example, in EP 0 745 731 A1.

In addition to the outlet 11, the filter upper part 7 forms a draw-off orifice 12 which has a filter housing 13 adjoining it. For this purpose, a peripheral flange 14 projects from the filter housing 13 and is connected to the filter upper part 7 via fastening elements 15 merely indicated.

Chambers 18 and 19, in which biofilter material is located, are formed in the filter housing 13 by means of intermediate plates 16 and 17. Particularly the intermediate plate 16 is, in this case, snapped into the filter housing 13, the filter housing 13 having integrally formed in it annular grooves 20 and 21 forming an inwardly pointing annular bead, on which the intermediate plates 16 and 17 rest in each case. Furthermore, catch bosses 22 are also integrally formed in the filter housing 13 above the intermediate plate 16, so that the latter is snapped in between the catch bosses 22 and the annular bead formed by the annular groove 20.

Furthermore, slots 24, through which waste air can penetrate into the filter housing 13, are integrally formed in a bottom 23. The waste air flows through the filter material in the chambers 19 and 18 and also the intermediate plates 17 and 16 which have corresponding orifices. The purified waste air thereafter flows through the draw-off orifice 12 and can escape into the open through the outlet orifice 10 or the orifice 3 of the mounting ring 1.

Moreover, a sealing ring 35 is also pushed onto the mounting ring 1. According to FIG. 3, this sealing ring is designed with a D-shaped cross section and possesses a back 36 and a curved part 37. Perforations 38 are integrally formed at intervals in the curved part 37.

Figures 2, 3:
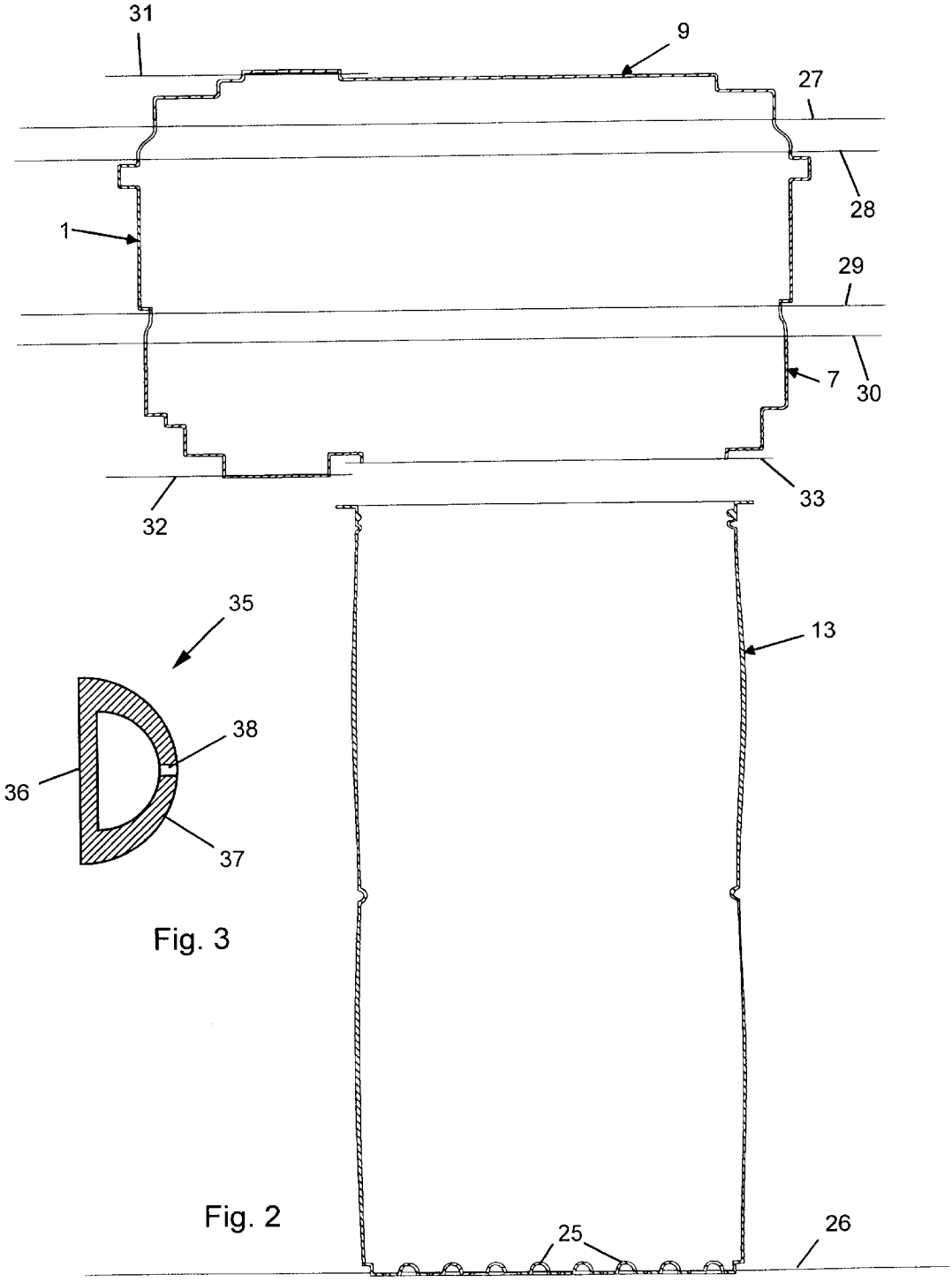
FIG. 2 shows a cross section through preforms for producing the biofilter according to FIG. 1.
FIG. 3 shows a cross section through a sealing ring according to the invention.

The biofilter according to the invention is produced as follows:

Two molds are required for production. The filter housing 13 is produced in one mold, while all the other parts are produced in the other mold. This is indicated in FIG. 2.

Corrugations 25, which form the bottom 23, are cut through in order to produce the slots 24. The corresponding cutting line is designated by 26.

The mounting ring 1, filter upper part 7 and cover 9 are produced in one mold and are subsequently cut. In this case, the cutting lines 27 and 28 separate the cover 9 from the mounting ring 1, while the filter upper part 7 is separated from the mounting ring 1 by means of the cutting lines 29 and 30. The outlet orifice 10, outlet 11 and draw-off orifice 12 are produced by means of the cutting lines 31 to 33.

After this operation of producing the individual elements from plastic in corresponding molds, the intermediate plates 16 and 17 are snapped into the filter housing 13, the corresponding filter material being inserted into the chambers 18 and 19. The filter housing 13 is thereafter connected to the filter upper part 7 via the fastening elements 15. The cover 9 is inserted upside down into the filter upper part 7, so that the orifice 10 is located above the outlet 11. This cover 9 is preferably connected to the filter upper part 7 by means of a weld seam 34. The attachment of the closing flap for closing the outlet 11 is subsequently carried out.

In order to exchange the filter material or else clean the biofilter, it is necessary merely to remove a grid, not shown in any more detail, from the mounting ring 1. The entire unit consisting of the cover 9, filter upper part 7 and filter housing 13 can subsequently be drawn out of the mounting ring 1 and replaced by a new, cleaned insert 6.

What is claimed is:

1. A biofilter for installation in a manhole of a discharge system comprises:

a mounting ring having an inner flange;

a filter housing provided with a biofilter media for purifying waste air discharged from said system, the filter housing having a filter upper part removably supported on the inner flange for supporting the filter housing in the collecting funnel, the filter upper part having a draw-off orifice for purified air and an outlet; and a cover inserted into the filter upper part, the cover having an outlet orifice which communicates the outlet in the filter upper part.

2. The biofilter as claimed in claim 1, wherein the mounting ring has supporting bosses for resting on a shoulder of said manhole.

3. The biofilter as claimed in claim 1, wherein the inner flange has an inner seal with adhesive on at least one side to adhere to the inner flange.

4. The biofilter as claimed in claim 3, wherein the filter upper part rests on the inner seal.

5. The biofilter as claimed in claim 1, wherein the outlet is disposed directly below the outlet orifice.

6. The biofilter as claimed in claim 1, wherein at least one annular bead is integrally formed on the filter housing and a plate rests on the at least one annular bead.

7. The biofilter as claimed in claim 6, wherein the filter housing has a catch boss formed thereon and the plate is located between the at least one annular bead and the catch boss.

8. The biofilter as claimed in claim 1, wherein the mounting ring is provided with a sealing ring for sealing in a shoulder of said manhole.

9. The biofilter as claimed in claim 8, wherein the sealing ring is D-shaped and has a flat portion which bears on the mounting ring and a curved portion.

10. The biofilter as claimed in claim 9, wherein the flat portion of the sealing ring is more rigid than the curved portion.

11. The biofilter as claimed in claim 8, wherein the sealing ring is rubber.

12. The biofilter as claimed in claim 8, wherein perforations are formed in the sealing ring.

* * * * *